US008505627B2

(12) United States Patent
Cox

(10) Patent No.: US 8,505,627 B2
(45) Date of Patent: Aug. 13, 2013

(54) DOWNHOLE SEPARATION AND REINJECTION

(75) Inventor: Ryan Cox, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 736 days.

(21) Appl. No.: 12/573,549

(22) Filed: Oct. 5, 2009

(65) Prior Publication Data

US 2011/0079388 A1 Apr. 7, 2011

(51) Int. Cl.
*E21B 43/12* (2006.01)
*E21B 43/20* (2006.01)
*E21B 43/38* (2006.01)

(52) U.S. Cl.
USPC ..... 166/266; 166/50; 166/275; 166/68

(58) Field of Classification Search
USPC ..... 166/266, 267, 268, 245, 68, 105, 166/275, 50
See application file for complete search history.

(56) References Cited

U.S. PATENT DOCUMENTS

| | | | | |
|---|---|---|---|---|
| 2,281,801 | A * | 5/1942 | Reynolds et al. | 166/306 |
| 4,793,408 | A * | 12/1988 | Miffre | 166/53 |
| 5,762,149 | A * | 6/1998 | Donovan et al. | 175/40 |
| 6,167,965 | B1 * | 1/2001 | Bearden et al. | 166/250.15 |
| 6,213,208 | B1 * | 4/2001 | Skilbeck | 166/265 |
| 6,277,286 | B1 * | 8/2001 | Søntvedt et al. | 166/250.03 |
| 6,279,651 | B1 * | 8/2001 | Schwendemann et al. | 166/54.1 |
| 6,279,658 | B1 * | 8/2001 | Donovan et al. | 166/313 |
| 6,845,821 | B2 * | 1/2005 | Bouma et al. | 166/369 |
| 6,923,259 | B2 * | 8/2005 | Snow | 166/265 |
| 2003/0205522 | A1 * | 11/2003 | Polderman et al. | 210/532.1 |
| 2006/0180316 | A1 * | 8/2006 | Steele et al. | 166/381 |

* cited by examiner

*Primary Examiner* — Kenneth L Thompson
(74) *Attorney, Agent, or Firm* — Jim Patterson

(57) ABSTRACT

A technique enhances hydrocarbon fluid production. The technique utilizes a well with a plurality of lateral wellbores positioned to facilitate removal of well fluid from a hydrocarbon reservoir. A separator is disposed in the well to receive well fluid that flows from a lateral production leg. Operation of the separator separates well fluid into an oil component and a water component to enable production of the oil component. The water component is injected into the reservoir in a manner that drives well fluid trapped in the reservoir into the lateral production leg.

23 Claims, 2 Drawing Sheets

DOWNHOLE SEPARATION AND REINJECTION

BACKGROUND

In many well related applications, hydrocarbon fluids, e.g. oil, are held in subterranean formations and various techniques are used to retrieve the desired hydrocarbon fluids from the subterranean formations. However, difficulties often arise in obtaining the desired flow of hydrocarbon fluids from the formation to a location where the fluids can be pumped from the well. Additionally, water often is mixed with the oil or becomes mixed with the oil during the retrieval process. The unwanted water must be separated from the oil and moved to a suitable disposal location.

SUMMARY

In general, the present application provides a technique for enhancing hydrocarbon fluid production. The technique utilizes a well with a plurality of lateral wellbore sections that may comprise at least one lateral production leg and at least one lateral injection leg. A separator is disposed in the well to receive well fluid that flows from the lateral production leg. Operation of the separator separates well fluid into an oil component and a water component to enable production of the oil component. The water component is injected into a reservoir via, for example, the lateral injection leg in a manner that drives well fluid trapped in the reservoir into the lateral production leg.

BRIEF DESCRIPTION OF THE DRAWINGS

Certain embodiments will hereafter be described with reference to the accompanying drawings, wherein like reference numerals denote like elements, and.

DETAILED DESCRIPTION

In the following description, numerous details are set forth to provide an understanding of various embodiments. However, it will be understood by those of ordinary skill in the art that the present embodiments may be practiced without these details and that numerous variations or modifications from the described embodiments may be possible.

The present application generally relates to a technique for enhancing hydrocarbon production from subterranean formations. For example, the technique is useful for improving oil recovery and flow rates in a reservoir region between multilateral wells. The well fluid from one leg of a multilateral well is delivered to a downhole separator which separates water and oil from the well fluid. The oil component is produced to a collection location, while the water component is injected into the reservoir at a location designed to drive well fluid from the reservoir and into the leg that enables delivery to the downhole separator.

By way of example, the water component may be injected into an injection leg of the multilateral well. From the injection leg, the water moves back into the reservoir and provides pressure support which drives the well fluid in the reservoir towards the production leg cooperating with the downhole separator. The ability to utilize the injected water component improves recovery of trapped oil between the multilateral legs. Downhole water separation devices used in combination with suitable completion designs and reservoir modeling facilitate improved recovery of the desired hydrocarbon fluids in the reservoir.

Figure 1:
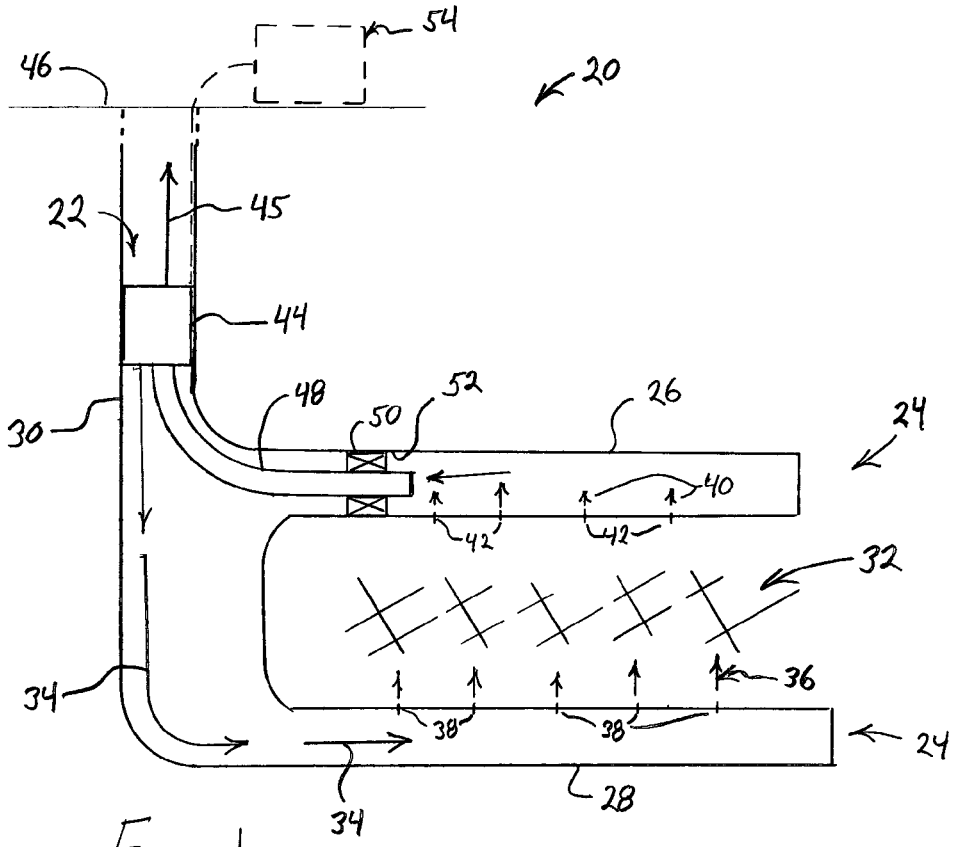
FIG. 1 is a schematic view of a well system in which a water component and an oil component are separated and the water component is used to facilitate further production, according to an embodiment.

Referring generally to FIG. 1, an example of a well system 20 is illustrated according to an embodiment. In the illustrated embodiment, well system 20 comprises a well 22 that may be a multilateral well having a plurality of lateral wellbore sections 24. In the specific example illustrated, lateral wellbore sections 24 comprise a production leg 26 and an injection leg 28 that are each coupled with a generally vertical wellbore section 30.

The lateral wellbore sections 24 extend into and/or through a reservoir 32 bearing hydrocarbon fluids, such as oil. In the example illustrated, injection leg 28 is positioned generally beneath production leg 26. However, a variety of lateral wellbore section arrangements may be utilized depending on parameters related to the environment, reservoir and multilateral well.

Water is injected into an injection leg 28, as represented by arrows 34, and the flow of water is directed from injection leg 28 into reservoir 32, as represented by arrows 36. The flow of water injected into reservoir 32 is distributed to provide a desired pressure support along reservoir 32 and to drive the well fluids in reservoir 32 toward production leg 26. If injection leg 28 is lined, appropriate openings/perforations 38 can be formed through the liner or casing to enable the desired injection of water into reservoir 32.

The pressure support provided by the injected water drives well fluids in reservoir 32 toward production leg 26. As represented by arrows 40, the well fluid flows into an interior of production leg 26 for processing. Again, if production leg 26 is lined, appropriate openings/perforations 42 are formed through the liner or casing to enable flow of well fluid from reservoir 32 into production leg 26.

From production leg 26, the well fluid is directed to a separator 44 which is operated to separate the well fluid into an oil component and a water component. The oil component is produced along the wellbore, as represented by arrow 45, to a collection location, e.g. a surface location 46, and the water component is directed to injection leg 28. In the specific example illustrated, the oil and water separator 44 is positioned in vertical wellbore section 30 and placed in fluid communication with production leg 26 via a suitable tubing 48 or other completion component. Additionally, an isolation device 50, such as a packer, may be deployed between tubing 48 and a surrounding wall 52 of production leg 26 generally at a proximal end of production leg 26. The packer 50 serves to isolate production leg 26 from water flow 34 and unwanted pressures while ensuring transfer of the well fluid to separator 44. It should be noted that a variety of completion designs may be used and may include additional and/or alternate components to change or supplement tubing 48 and isolation device 50.

As explained in greater detail below, the fluid flows may be monitored and controlled via a control system 54. By way of example, control system 54 may comprise a computerized control system positioned at a surface location or other suitable location. The control system 54 enables monitoring of a variety of characteristics, including characteristics such as temperature, pressure, flow rates, oil-to-water ratios, and other characteristics that facilitate management of the well and optimization of the hydrocarbon production. The control system 54 also may utilize a variety of control features, such as control valves that control flow of the water component, well fluid, and/or oil component.

Figure 2:
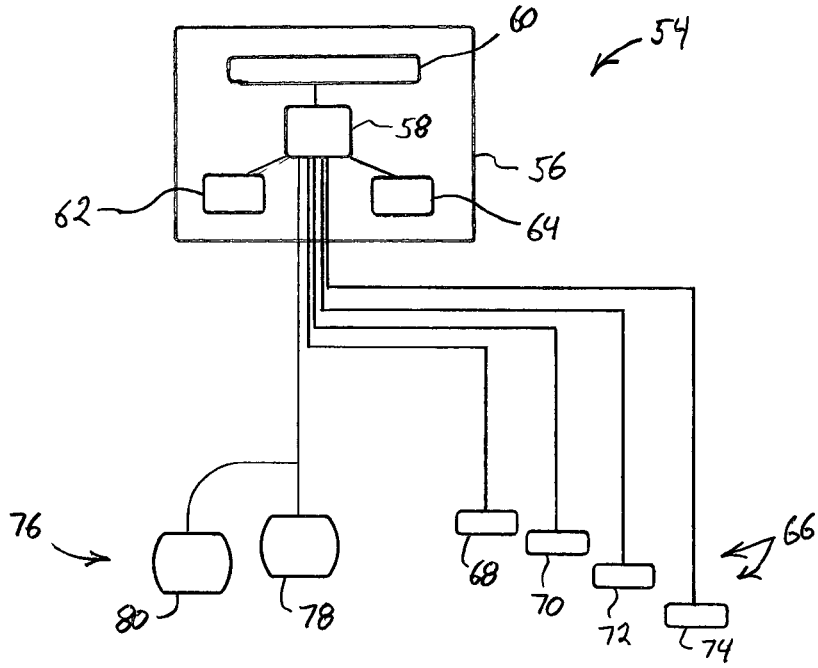
FIG. 2 is a schematic illustration of one example of a control system for use in the well system illustrated in FIG. 1, according to an embodiment.

Referring generally to FIG. 2, one example of control system 54 is illustrated schematically. In this embodiment, control system 54 comprises a computer-based controller 56 that may be an automated system to automatically adjust flow parameters related to the production of oil and/or the injection of water. The computer-based controller 56 also may be designed for interaction with an operator and/or operation on a partially automated basis.

The computer-based controller 56 has a central processing unit (CPU) 58 operatively coupled with a memory 60, an input device 62, and an output device 64. Input device 62 may comprise a variety of devices, such as a keyboard, mouse, voice-recognition unit, touchscreen, other input devices, or combinations of such devices. Output device 64 may comprise a visual and/or audio output device, such as a monitor having a graphical user interface. Additionally, the processing of data and control functions may be performed on a single device or multiple devices at the well location, away from the well location, or with some devices located at the well and other devices located remotely.

As illustrated, the CPU 58 of computer-based controller 56 may be operatively coupled with a variety of devices. For example, the computer-based controller 56 may process data from a variety of sensors 66 positioned at appropriate locations within multilateral wellbore 22. Depending on the techniques utilized for monitoring fluid flow and the overall function of well system 20, sensors 66 may comprise, for example, one or more temperature sensors 68, one or more pressure sensors 70, one or more flow rate sensors 72, and one or more of a variety of other sensors 74, such as oil-to-water ratio sensors. The sensors 66 may be deployed at numerous locations within multilateral wellbore 22. For example, sensors may be deployed in separator 44, along tubing 48, within production leg 26, within injection leg 28, or at other desired locations to monitor the injection and/or production processes.

Data obtained from sensors 66 is output to CPU 58 which processes the data to determine whether control adjustments are needed. The CPU 58 can output information to an operator and/or automatically perform system control adjustments. Regardless of whether the control instructions are input by an operator or determined automatically, control signals are provided to control devices 76 located downhole. By way of example, control devices 76 may comprise a valve system (or other flow control device) 78 which can be adjusted to control the flow, e.g. flow rate, of water injected into the reservoir 32. The control devices 76 also may comprise a valve system (or other flow control device) 80 positioned to control the flow, e.g. flow rate, of well fluid into separator 44 and/or oil out of separator 44. In one embodiment, control devices 76 are positioned adjacent or within separator 44 to control the various fluid flows of well system 20.

Figure 3:
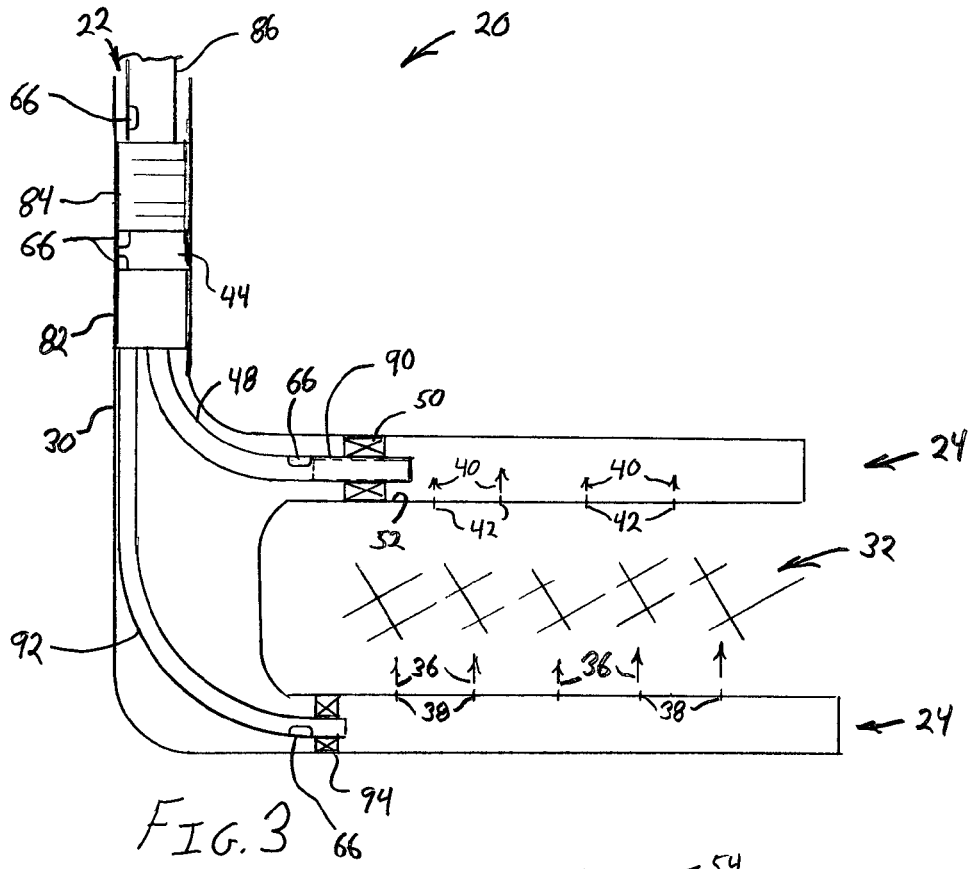
FIG. 3 is a schematic illustration of another example of the well system illustrated in FIG. 1, according to an alternate embodiment.

Another example of well system 20 is illustrated in FIG. 3. In this embodiment, control devices 76 are combined in a control assembly 82 positioned adjacent separator 44. Additionally, a submersible pumping system 84, such as an electric submersible pumping system, is positioned adjacent separator 44 to operate in cooperation with separator 44. For example, submersible pumping system 84 may be used to produce the oil component up through a tubing 86 to surface location 46. It also should be noted that additional or alternate submersible pumping systems may be employed at other locations to facilitate the movement of fluid. By way of example, an alternate submersible pumping system 90, as shown in dashed lines, may be disposed in or adjacent production leg 26 to facilitate movement of well fluid to separator 44.

The well system also may comprise other components, such as an injection tubing 92 into which water separated by separator 44 is directed. Injection tubing 92 routes the water into injection leg 28 for injection into reservoir 32. A packer 94 or other isolation device may be used to isolate injection leg 28. Additionally, sensors 66 may be positioned at various locations to monitor fluid flow and to provide data to computer-based controller 56. In the illustrated example, sensors 66 are positioned along tubing 48, along injection tubing 92, in or along the separator 44, and along tubing 86. However, these locations are examples and the actual placement of sensors as well as the number of sensors can vary from one application to another.

Figure 4:
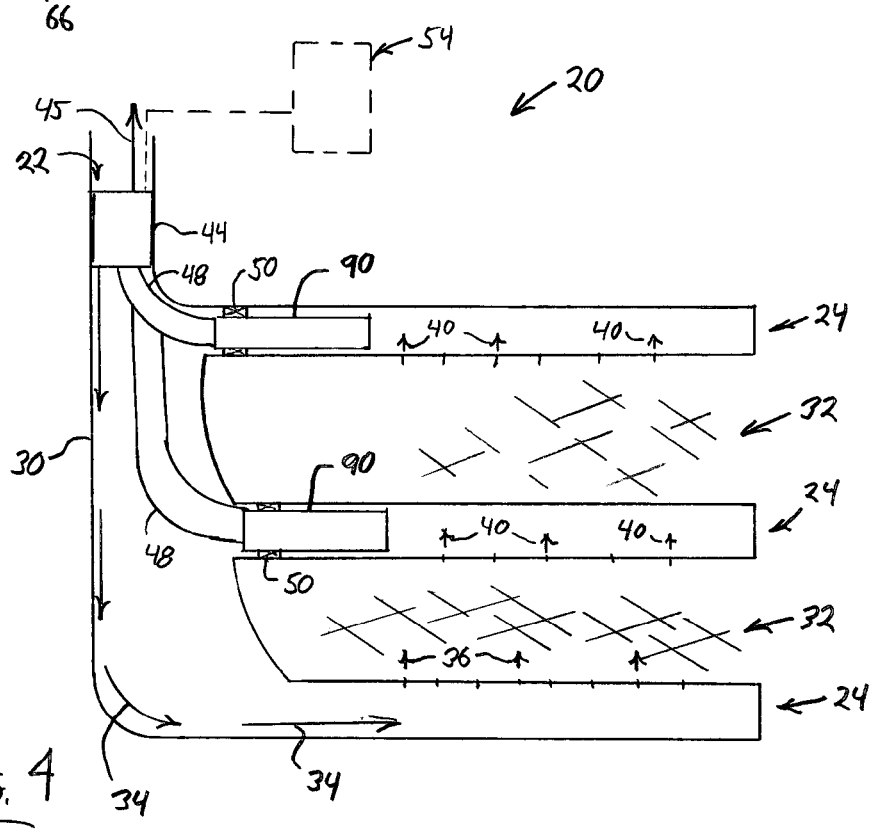
FIG. 4 is a schematic illustration of another example of the well system illustrated in FIG. 1, according to an alternate embodiment.

Referring generally to FIG. 4, another example of well system 20 is illustrated. In this example, multilateral wellbore 22 comprises at least three lateral wellbore sections 24, and the number and position of production legs versus injection legs may be selected according to the characteristics of reservoir 32. For example, the lowermost lateral wellbore section 24 may serve as the injection leg 28, while the upper two lateral wellbore sections 24 serve as production legs. However, the number and arrangement of lateral wellbore sections 24 can vary according to the environment and the type of production operation.

In the example illustrated, submersible pumping systems 90 are deployed in the upper two lateral wellbore sections 24 to produce well fluid to separator 44. The submersible pumping systems 90 may be used to provide the power for separating water from the well fluid and for producing the oil component to a surface location. However, another submersible pumping system, e.g. submersible pumping system 84, may be deployed above the separator 44 to facilitate production of oil to a surface collection location. In this example, the separated water is again directed downwardly and injected into reservoir 32 via, for example, the lowermost lateral wellbore section 24.

The control system 54 may again be used to monitor downhole parameters and to control fluid flows. If submersible pumping systems are employed, control system 54 also may be used to control operation of the one or more submersible pumping systems. In some applications, the entire monitoring and control functions are automated by programming desired control logic, algorithms, and/or other software on computer-based controller 56. As a result, the oil and water separation along with the production of oil and the injection of water can be controlled in a desired manner that optimizes removal of well fluid from reservoir 32.

System 20 may be constructed in a variety of configurations for use in many types of well applications. For example, the production enhancement technique may be used with multilateral wells having pairs of lateral wellbore sections or greater numbers of lateral wellbore sections in various patterns. The injection of water may be performed along a lateral injection leg and/or at other injection locations depending on the configuration of the reservoir. The lateral wellbore sections also may be formed in a variety of sizes and lengths according to reservoir and other environmental parameters.

Additionally, the monitoring and injection may be controlled according to a variety of control regimes that may be adjusted to maximize production of well fluid from a given reservoir. The monitoring may be accomplished by individual sensor types or combinations of sensor types arranged in a variety of patterns to monitor fluid flows and other production/injection characteristics. The data from the sensors can be fed to a variety of systems, such as the computer-based control system described above. Additionally, control over fluid flows may be exercised by a variety of control mechanisms, including a valve system having valves deployed in one or more of the well fluid, oil component, and water component flows. Furthermore, various electric submersible pumping systems or other pumping systems may be used in cooperation with the separator to facilitate the flows of fluid and the production of oil to a desired collection location. Various completion components, including tubing sections and isolation devices, also may be employed to facilitate the desired fluid flows with respect to specific lateral wellbore sections.

Although only a few embodiments have been described in detail above, those of ordinary skill in the art will readily appreciate that many modifications are possible without materially departing from the teachings herein. Accordingly, such modifications are intended to be included within the scope defined in the claims herein and subsequent related claims.

What is claimed is:

1. A system for enhancing hydrocarbon production, comprising:

a wellbore having:

a vertical wellbore section; and a plurality of lateral wellbore sections extending laterally from the vertical wellbore section, the plurality of lateral wellbore sections comprising a lateral production leg and a lateral injection leg;

an electric submersible pumping system deployed in the lateral production leg wherein the electric submersible pumping system comprises production tubing; and a separator disposed in the wellbore to receive well fluid from the lateral production leg via the production tubing, the separator being operable to separate water and oil from the well fluid received via the production tubing, wherein the oil is directed to a surface location and the water is directed into the lateral injection leg in a manner to drive well fluid into the lateral production leg and wherein the electric submersible pumping system deployed in the lateral production leg provides power for separation of the water and the oil from the well fluid by the separator.

2. The system as recited in claim 1, further comprising a control system to control the flow of oil and water.

3. The system as recited in claim 2, wherein the control system comprises a plurality of sensors positioned along the wellbore.

4. The system as recited in claim 3, wherein the plurality of sensors comprises a temperature sensor.

5. The system as recited in claim 3, wherein the plurality of sensors comprises a pressure sensor.

6. The system as recited in claim 3, wherein the plurality of sensors comprises a flow rate sensor.

7. The system as recited in claim 1, wherein the plurality of lateral wellbore sections comprises two lateral wellbore sections.

8. The system as recited in claim 1, wherein the plurality of lateral wellbore sections comprises at least three lateral wellbore sections.

9. The system of claim 1 wherein the electric submersible pumping system provides for production of the oil from the separator to the surface location.

10. The system of claim 1 comprising another electric submersible pumping system deployed above the separator for production of the oil from the separator to the surface location.

11. The system of claim 1 comprising a control system to control operation of the electric submersible pumping system.

12. The system of claim 10 comprising a control system to control operation of the electric submersible pumping system deployed in the lateral production leg and the electrical submersible pumping system deployed above the separator.

13. The system of claim 11 wherein the control system comprises control logic to control separation of the water and the oil from the well fluid from the lateral production leg, to control production of the oil to a surface location, and to control injection of the water into the lateral injection leg.

14. The system of claim 11 comprising sensors deployed in the wellbore for sensing temperature, pressure and flow rate wherein the sensors provide data to the control system to control operation of the electric submersible pumping system.

15. A method for enhancing hydrocarbon production, comprising:

forming a plurality of lateral wellbores including a lateral production leg and a lateral injection leg;

employing an electric submersible pumping system in the lateral production leg fitted with production tubing for flowing a well fluid from the lateral production leg via the production tubing to a separator, deployed in a wellbore above the lateral production leg, to power the separator for separating water from the well fluid;

directing the water into the lateral injection leg; and using the water directed into the lateral injection leg to drive well fluid from an adjacent reservoir into the lateral production leg.

16. The method as recited in claim 15, further comprising joining the plurality of lateral wellbores with a generally vertical section of the wellbore; and locating the separator in the generally vertical section of the wellbore.

17. The method as recited in claim 15, wherein forming comprises forming two lateral wellbores.

18. The method as recited in claim 15, further comprising providing a flow controller to control the flows of fluid from the separator.

19. The method as recited in claim 15, further comprising routing to a surface location oil separated from the well fluid by the separator.

20. The method as recited in claim 18, further comprising using sensors deployed in the wellbore to monitor fluid flows in the wellbore.

21. The system of claim 1 comprising a packer deployed between the electric submersible pump or the production tubing and a wall of the lateral production leg to isolate the lateral production leg.

22. The method of claim 19 comprising operating the electric submersible pumping system for producing the oil to the surface location.

23. The method of claim 19 comprising employing another electric submersible pumping system in the wellbore, above the separator, for producing the oil to the surface location.

* * * * *